US008490337B2

(12) United States Patent
Word, III et al.

(10) Patent No.: US 8,490,337 B2
(45) Date of Patent: Jul. 23, 2013

(54) STRUCTURAL FLANGE CONNECTION SYSTEM AND METHOD

(76) Inventors: Thomas Nott Word, III, Tulsa, OK (US); Cecil Leon Hartman, Jr., Jenks, OK (US)

( * ) Notice: Subject to any disclaimer, the term of this patent is extended or adjusted under 35 U.S.C. 154(b) by 242 days.

(21) Appl. No.: 12/783,763

(22) Filed: May 20, 2010

(65) Prior Publication Data

US 2010/0307097 A1 Dec. 9, 2010

Related U.S. Application Data

(60) Provisional application No. 61/185,238, filed on Jun. 9, 2009.

(51) Int. Cl.
*E04H 12/00* (2006.01)

(52) U.S. Cl.
USPC ..... 52/40; 52/588.1; 52/584.1; 52/585.1

(58) Field of Classification Search
USPC ..... 52/588.1, 584.1, 585.1, 848, 849, 52/223.5, 40, 223.3, 578, 582.1, 586.1, 586.2, 52/590.1, 590.2; 416/DIG. 6
See application file for complete search history.

(56) References Cited

U.S. PATENT DOCUMENTS

| | | | | |
|---|---|---|---|---|
| 1,067,804 | A * | 7/1913 | Davis | 52/248 |
| 2,929,236 | A * | 3/1960 | Steward et al. | 52/223.3 |
| 4,454,699 | A * | 6/1984 | Strobl | 52/585.1 |
| 4,910,940 | A * | 3/1990 | Grady, II | 52/849 |
| 5,333,436 | A * | 8/1994 | Noble | 52/849 |
| 5,687,537 | A * | 11/1997 | Noble | 52/849 |
| 5,881,515 | A * | 3/1999 | George | 52/233 |
| 6,672,023 | B2 | 1/2004 | Henderson | |
| 7,096,639 | B2 | 8/2006 | Wobben | |
| 7,628,869 | B2 * | 12/2009 | Martin et al. | 148/320 |
| 7,665,273 | B2 * | 2/2010 | Fuellhaas et al. | 52/745.04 |
| 2005/0005562 | A1 | 1/2005 | Henderson et al. | |
| 2005/0129504 | A1 | 6/2005 | De Roest | |
| 2006/0123735 | A1 * | 6/2006 | Fuellhaas et al. | 52/741.13 |

(Continued)

FOREIGN PATENT DOCUMENTS

| | | |
|---|---|---|
| JP | 2000115972 | 4/2000 |
| KR | 200118899 | 8/1998 |
| KR | 100890377 | 3/2009 |
| KR | 2020100003286 | 3/2010 |

*Primary Examiner* — Jeanette E Chapman
*Assistant Examiner* — James Buckle, Jr.
(74) *Attorney, Agent, or Firm* — Head, Johnson & Kachigian, P.C.

(57) ABSTRACT

A structural flange connection system and method that utilizes structural flanges having a standard bolted connection and a mechanical bond to effectively manage and assist the retention of bolt preloads and substantially eliminate movement between the flange faces due to a reduction in the need for friction load being generated by the bolt clamping force in the flange connection. The structural flanges of the structural flange connection system and method each include an outer rim and a flange lip having a face and a shoulder. The structural flange connection system and method may be utilized in the manufacture and installation of a wind turbine tower, which may be made up of one or more tower sections, and each tower section may terminate in structural flanges of the structural flange connection system and method. When properly aligned, the structural flanges may be bolted together. When each tower section is properly aligned and bolted, the mechanical bond of the structural flanges is also joined together. Such manufacture of the wind turbine tower may occur in the field during installation of the wind turbine tower.

20 Claims, 6 Drawing Sheets

U.S. PATENT DOCUMENTS

| | | | | |
|---|---|---|---|---|
| 2006/0228218 | A1 | 10/2006 | Cone | |
| 2007/0245680 | A1 | 10/2007 | Cairo | |
| 2008/0041009 | A1* | 2/2008 | Cairo et al. | 52/651.07 |
| 2008/0308696 | A1 | 12/2008 | Kristensen | |
| 2009/0016897 | A1 | 1/2009 | Olgaard | |
| 2009/0021019 | A1 | 1/2009 | Thomsen | |
| 2009/0044482 | A1 | 2/2009 | Tooman | |
| 2009/0300996 | A1* | 12/2009 | Jones | 52/40 |
| 2010/0058673 | A1* | 3/2010 | Numajiri | 52/40 |
| 2011/0232071 | A1* | 9/2011 | Knoop et al. | 29/525.02 |

* cited by examiner

STRUCTURAL FLANGE CONNECTION SYSTEM AND METHOD

CROSS-REFERENCE TO RELATED APPLICATIONS

This application claims priority to U.S. Provisional Application Ser. No. 61/185,238 filed Jun. 9, 2009, which is incorporated herein by reference.

BACKGROUND OF THE INVENTION

1. Field of the Invention

This invention relates generally to a structural flange connection system and method, and more particularly to a structural flange connection system and method that utilizes structural flanges having a standard bolted connection and a mechanical bond effectively managing and assisting the retention of bolt preloads, and substantially eliminating movement between the flange faces, due to a reduction in the compromise of bolt preload due to flange face mismatch which can occur during the production of the flange connection joint.

2. Description of the Related Art

A great deal of interest is presently being shown in the development of alternative energy sources, particularly wind energy. New and more efficient wind turbine generators are being developed that are larger and produce more energy, but also produce more problems with regard to wind turbine tower design that combat the operational forces prevalent in normal operations of the wind turbine. Normal operations of the wind turbine create harmonic vibrations with each revolution of the turbine blades. Much research has been performed in tower operations in an effort to minimize vibration and stresses that ultimately cause metal fatigue and tower failure.

Wind turbine towers are typically constructed from rolled plate sections (cans), to which connection flanges are welded on each end, allowing a mechanical connection of the cans using bolts through the connection flange coupled to a nut on the opposite side of the flange, to create towers that range up to 300 feet in height. Each tower is made up of sections that can be shipped to the wind farm locations for erection. Typically two (2) to four (4) sections are utilized, depending on the height of the tower. Each section is attached to proximate sections by the use of connection flanges. These flanges can vary in diameter from approximately fifteen (15) feet at the bottom of the tower to approximately six (6) to eight (8) feet at the top of the tower where the turbine is attached. These flanges are bolted together using some 125 to 130 high strength bolts.

Because of the vibrations and stresses, these bolts are designed to be very tight with very high torque values. The high torque values generate high clamping loads in the bolted connection, which are far in excess of any fluctuating loads the joint experiences due to service loads, such as varying wind speed and direction, rated turbine power, rotating frequency, yaw angle and gyroscopic force generated by the change in the direction of the plane in which the blades of the turbine rotate. As the fluctuating loads are a small part of the load the joint experiences relative to the bolt clamping load, metal fatigue in the bolts is reduced as long as the clamping force is maintained. However, this clamping load can be compromised in service by the fact that manufacturing tolerances can result in the flange contact surfaces not being ideally plane. If a service load can cause the distance between the opposite flange faces of a bolted connection to settle or otherwise be reduced, the bolt in that connection un-stretches and the clamping load is reduced. As the clamping load is now a smaller part of the overall load experienced by the bolt, and the fluctuating load is a larger portion of that load, there is a potential for metal fatigue to be generated within the bolt of the connection, leading to its eventual failure. These forces that are inherent with normal wind tower turbine operations create the need for strict and costly maintenance procedures to ensure that the bolts at the flange joints are torqued to design specifications in order to maintain their design preload and re-establish any preload compromised due to a settling or deflection of the flange connection faces, and any damaged or failed due to metal fatigue are replaced in a timely manner.

Current practice dictates that the bolt tension of a flanged joint connection of a wind turbine tower must be checked after the first 500 hours of service. This is necessary because initially, the flange connection rests on dimensional imperfections of the flange faces, which generate areas of contact. These areas of contact can yield during initial loading and load cycling as the wind turbine tower is put into service. As these small deformations occur and the flange connections settle, dimensional variations between the mating flange faces can compromise the preload of the bolted connection. A maintenance operation of restoring the desired preload to the bolts by re-torquing them after the initial amount of service is required to assure that the bolt preload is restored, in case of such dimensional deflection.

If the flange faces are distorted by the manufacturing process, then a mismatch can occur. The net result of a mismatch is to form an area of higher stress in a given area of the flange. Depending on the installation and the location and degree of the distortion, this area of higher stress may yield, which could serve as a pivot or fulcrum about which shearing might be focused in order to affect a movement of the flanges at another location.

A potential for flange mismatch is generated by the nature of fabricating the tower sections. The vertical walls of the tower section are joined to the flanges, typically by welding, as bolting would require additional maintenance tasks in addition to the current flange bolt checks. As materials are welded, they are joined by the change of phase of the steel from a solid to a liquid, and back again. During this phase change, the material decreases in density and increases in volume and undergoes growth due to thermal expansion. As the material in a liquid phase now flows under any pressure, some material is extruded from areas under load. When the resulting melted joint re-solidifies, shrinkage results due to the extrusion of some of the original parent material and the contraction of the parent material as it cools. Depending on the levels of heat generated during the welding process, and the position and orientation of the weld, distortion of the flanges can occur. Once the flange is joined to the tower section, it becomes impractical to turn these faces back to true by a lathe operation, as the tower diameters at the flange are in excess of fifteen (15) feet.

Metal materials subject to cyclical loading are vulnerable to metal fatigue, which is the initiation and propagation of small cracks through the metal components under load. In steel materials, an endurance limit can be determined for the steel through testing, but is generally accepted to be one half the tensile strength. In other words, a load equivalent to less than 50% of the tensile strength under a complete reversal of loading would be considered an infinite life load for ferrous materials. Additionally, the infinite life is further modified by factors, such as application safety, the surface finish and geometric arrangement of the material, which reduce the allowable stress in the target design of the components. These practices are to ensure that an adequate margin of safety exists in the design's load carrying ability, while not over-sizing components needlessly, and impacting design realization efforts and costs.

Ideally, the flanges of the structural connection between towers sections are preloaded by the bolted connections, such that a compressive stress is generated under the bolt head and nut, which exceeds any fluctuating loads experienced by the tower connection under functional loads, including generator reactive torque, gyroscopic loads due to change of direction of the turbine rotational axis, and dynamic loads due to imbalance or resonance. The mating flange faces are loaded under the nut and bolt, with the loading being relaxed between bolted connections. Axial loads transmitted through the tower about an axis parallel with the vertical axis of the tower are resisted by the friction generated between the flange faces under the clamping load of the bolts by the coefficient of friction between the flanges.

If frictional force is reduced due to compromise of the bolt clamping force, or by excessive torque being transmitted through the structure, the bolts can possibly be brought into shear loading by the reduction of clearance between the bolt clearance holes and the bolts themselves. Once contact of a bolt with the wall of a clearance hole is made, any additional movement of the joint will result in shear loading within the bolt, effectively trying to shear the bolt across its profile (diameter). Furthermore, if this load is fluctuating in operation, it will have the potential of generating metal fatigue in the bolts through shear loading.

The primary mode of failure that exists in the structural connections of wind tower joints appears to be bolt failure by the compromise of bolt preload. The bolts begin to experience fluctuating loads and stresses once the bolt preload is reduced, and this fluctuating load leads to fatigue failure of the bolt. A friction fit alone between bolted flanges can be inadequate, especially given cyclical or repetitive loading in wind turbine towers.

It is therefore desirable to provide a structural flange connection system and method that utilizes structural flanges having a standard bolted connection and a mechanical bond that effectively manage and assist the retention of bolt preloads and substantially eliminate movement between the flange faces due to a reduction in the friction load being generated by the bolt clamping force in the flange connection.

It is further desirable to provide a structural flange connection system and method for manufacturing a wind turbine tower that lessens the damage created from the stresses associated with its intended use.

It is still further desirable to provide a structural flange connection system and method that provides equal distribution of external forces and minimizes the flow of stress forces through the structural flange connection.

It is yet further desirable to provide a structural flange connection system and method that uses a means of structural interface which tolerates dimensional variation and provides more consistent joint performance in terms of dimensional stability of the distance between the nut and the bolt head of a bolted joint connection.

It is yet further desirable to provide a structural flange connection system and method that utilizes a joint construction that allows for and accommodates significant deformations of the mated parts to allow a more uniform loading and seating of the joint, by design and not by the incidental potential variation of the joint in the manufacturing process.

It is yet further desirable to provide a structural flange connection system and method that uses a tapered pin between the flanges and in parallel connection with the bolts in the joint to create a pre-determined point of yielding of material to allow a consistent seat of the flange joint.

It is yet further desirable to provide a structural flange connection system and method that utilizes a tapered pin sized to create a predictable plastic deformation in flange material to seat the joint rather than allowing unpredictable flange face mismatch to dictate the characteristic performance of the flanged joint.

It is yet further desirable to provide a structural flange connection system and method having a proper taper of the pins in the joint to ensure that the joint captures the maximum compressive force generated at any given pin, by means of static frictional forces resulting from the pressure being generated by the compression of the pin and the expansion of its mating tapered hole, along with the coefficient of friction between the two materials.

It is yet further desirable to provide a structural flange connection system and method that effectively creates a preload of the joint in order to supplement the bolt preloading and help prevent the bolts from experiencing fluctuating stresses in the joint, resulting in longer joint life.

SUMMARY OF THE INVENTION

In general, the invention relates to a structural flange connection system and method whereby a first tubular tower section having opposing terminal ends and a second tubular tower section also having opposing terminal ends are joined to form at least part of a wind turbine tower, where the first tower section has at least one end terminating in a first structural flange, the second tower section has at least one end terminating in a second structural flange, and the first structural flange is proximate to and aligns with the second structural flange when the first tower section is aligned with the second tower section. The face of the first structural flange opposes and is aligned along a parallel plane to the face of the second structural flange, and the first structural flange is axially spaced from and coaxially aligned with the second structural flange. A mechanical bond is formed between the first structural flange and the second structural flange, which are bolted together. The first structural flange and the second structural flange may each have a face, where the first tower section abuts the second tower section along the face of the first structural flange and the face of the second structural flange when the first tower section and the second tower section are aligned.

The first structural flange may have a series of bolt apertures upon the face of the first structural flange and the second structural flange have a series of bolt apertures upon the face of the first structural flange. The series of bolt apertures of the first structural flange and of the second structural flange are located on the face of the first structural flange and the face of the second structural flange, respectively, such that the series of bolt apertures of the first structural flange aligns with the series of bolt apertures of the second structural flange when the first tower section is aligned with the second tower section. When the first structural flange is bolted to the second structural flange, the mechanical bond is retained intermediate of the first structural flange and the second structural flange.

The first structural flange may have a first ring groove located upon the face of the first structural flange and the second structural flange may have a second ring groove located upon the face of the second structural flange, where the first ring groove and the second ring groove are located on the face of the first structural flange and the face of the second structural flange, respectively, such that the first ring groove aligns with the second ring groove when the first tower section is aligned with the second tower section. The first ring groove may extend around the face of the first structural flange in a circular pattern and the second ring groove may extend around the face of the second structural flange in a circular pattern. The mechanical bond between the first structural flange and the second structural flange may formed by placing a ring gasket between the first structural flange and the second structural flange such that the ring gasket is retained within the first ring groove and the second ring groove.

Alternately, the first structural flange may have a substantially V- or U-shaped groove located upon the face of the first structural flange and the second structural flange may have an inverted V- or U-shaped mating protrusion located upon the face of the second structural flange, where the groove and the mating protrusion are located on the face of the first structural flange and the face of the second structural flange, respectively, such that the groove aligns with the mating protrusion when the first tower section is aligned with the second tower section. The groove may extend around the face of the first structural flange in an annular pattern and the mating protrusion may extend around the face of the second structural flange in an annular pattern. The step of forming a mechanical bond between the first structural flange and the second structural flange may comprise nesting the mating protrusion within the groove.

Alternately, the first structural flange may have a series of apertures located upon the face of the first structural flange; the second structural flange may have a series of apertures located upon the face of the second structural flange; the series of apertures located upon the face of the first structural flange and the series of apertures located upon the face of the second structural flange may be located on the face of the first structural flange and the face of the second structural flange, respectively, such that the series of apertures located upon the face of the first structural flange aligns with the series of apertures located upon the face of the second structural flange when the first tower section is aligned with the second tower section; and the step of forming a mechanical bond between the first structural flange and the second structural flange may comprise placing a series of pins in the series of apertures located upon the face of the first structural flange and the series of apertures located upon the face of the second structural flange, such that each pin has a first end and a second end, the first end of each pin is located in one of the apertures in the series of apertures located upon the face of the first structural flange, and the second end of each pin is located in one of the apertures in the series of apertures located upon the face of the second structural flange. Each of the pins may be tapered on both the first end and the second end. The arctangent of the angle of each of the pins and the pin apertures in the first structural flange and the second structural flange is less than the coefficient of friction between each of the pins and the pin apertures in the first structural flange and the second structural flange.

Alternatively, the face of the first structural flange may have an inner span and an outer span, with the outer span having a series of protruding frusta located on the face of the first structural flange and the inner span having a series of mating detents located upon the face of the first structural flange. The face of the second structural flange may have an inner span and an outer span, with the outer span having a series of mating detents located upon the face of the second structural flange and the inner span having a series of protruding frusta located upon the face of the second structural flange.

The series of protruding frusta located upon the outer span of the face of the first structural flange and the series of mating detents located upon the outer span of the face of the second structural flange are located on the outer span of the face of the first structural flange and the outer span of the face of the second structural flange, respectively, such that the series of protruding frusta located upon the outer span of the face of the first structural flange aligns with the series of mating detents located upon the outer span of the face of the second structural flange when the first tower section is aligned with the second tower section. Further, the series of protruding frusta located upon the inner span of the face of the second structural flange and the series of mating detents located upon the inner span of the face of the first structural flange are located on the inner span of the face of the first structural flange and the inner span of the face of the second structural flange, respectively, such that the series of protruding frusta located upon the inner span of the face of the second structural flange aligns with the series of mating detents located upon the inner span of the face of the first structural flange when the first tower section is aligned with the second tower section.

The mechanical bond between the first structural flange and the second structural flange may be formed by fitting the series of protruding frusta located on the outer span of the face of the first structural flange in the series of mating detents located on the outer span of the face of the second structural flange and the series of protruding frusta located on the inner span of the face of the second structural flange in the series of mating detents located on the inner span of the face of the first structural flange, such that each of the protruding frustum located on the outer span of the face of the first structural flange is fit into one of the mating detents located on the outer span of the face of the second structural flange and each of the protruding frustum on the inner span of the face of the second structural flange is fit into one of the mating detents located on the inner span of the face of the first structural flange. The arctangent of the angle of each of the protruding frusta and the series of mating detents in the first structural flange and the second structural flange is less than the coefficient of friction between each of the protruding frusta and the series of mating detents in the first structural flange and the second structural flange.

Furthermore, the inner span of the face of the first structural flange may include the series of bolt apertures located upon the face of the first structural flange, while the inner span of the face of the second structural flange may include the series of bolt apertures located upon the face of the second structural flange. In such a case, the series of bolt apertures located upon the inner span of the face of the first structural flange and of the second structural flange are located on the inner span of the face of the first structural flange and the inner span of the face of the second structural flange, respectively, such that the series of bolt apertures located upon the inner span of the face of the first structural flange aligns with the series of bolt apertures located upon the inner span of the face of the second structural flange when the first tower section is aligned with the second tower section.

Other advantages and features will be apparent from the following description and from the claims.

DETAILED DESCRIPTION OF THE INVENTION

The systems and methods discussed herein are merely illustrative of specific manners in which to make and use this invention and are not to be interpreted as limiting in scope.

While the systems and methods have been described with a certain degree of particularity, it is to be noted that many modifications may be made in the details of the construction and the arrangement of the structural and functional devices, components and/or steps without departing from the spirit and scope of this disclosure. It is understood that the systems and methods are not limited to the embodiments set forth herein for purposes of exemplification.

Figure 1:
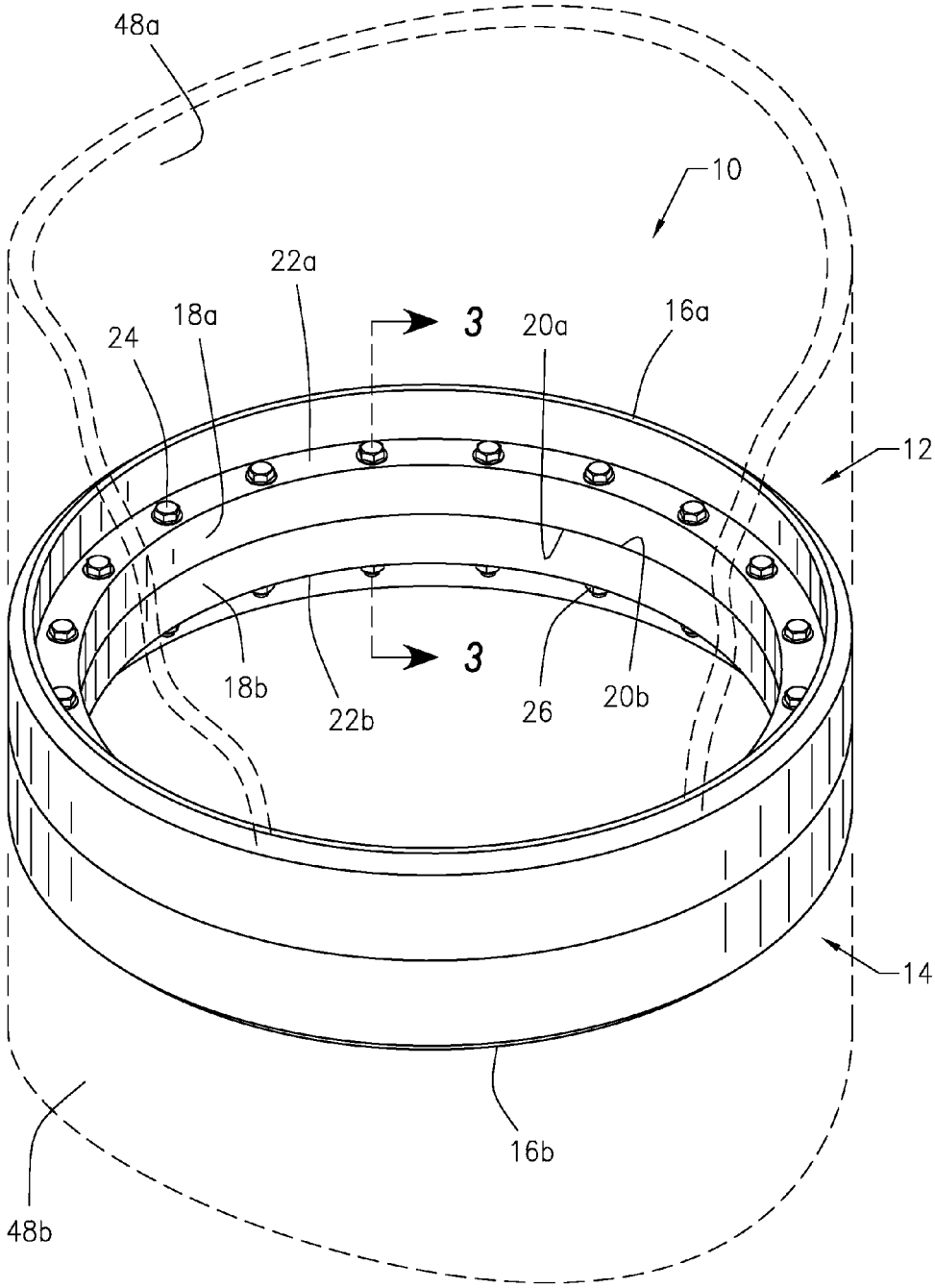
FIG. 1 is partial cutaway perspective view of a tower section terminating in structural flanges in accordance with an illustrative embodiment of the structural flange connection system and method disclosed herein.

Referring to the figures of the drawings, wherein like numerals of reference designate like elements throughout the several views, and initially to FIG. 1, a structural flange connection system and method 10 utilizes structural flanges 12 and 14 having a mechanical bond that manages and assists the retention of bolt preloads and eliminates movement between the flange faces due to the reduction in the friction load being generated by the bolt clamping force in the joint. The structural flanges 12 and 14 of the structural flange connection system and method 10 may each include an outer rim 16*a* and 16*b* and a flange lip 18*a* and 18*b* having a face 20*a* and 20*b* and a shoulder 22*a* and 22*b*. The shoulder 22*a* and 22*b* respectively of the structural flanges 12 and 14 have aligned apertures 42*a* and 42*b* through which a bolt 24 is passed and secured with a nut 26. The head of the bolt 24 engages the outer rim 16*a* of the structural flange 12, while the nut 26 engages the outer rim 16*b* of the structural flange 14. As the clamping force imparted by the bolt 24 and the nut 26 increases, the friction between the engaged surfaces of the nut 26 and the threads of the bolt 24 increases. As this frictional force increases, more torque is required to turn the nut 26 to generate additional clamping force. There is, however, a limit when the bolt clamping force acting with the coefficient of friction between the nut 26 and the bolt 24 equals the torsional stiffness of the bolt 24, at which point the bolt 24 twists under the torque supplied by a wrench or nut tightening device (not shown) rather than the nut 26 turning and generating additional clamping force. Therefore, pursuant to the structural flange connection system and method 10, nuts 26 and bolts 24 may be lubricated before being torqued in order to reduce the coefficient of friction so that the torque on the nut 26 can be more effective in generating bolt stretch and clamping force, rather than being transmitted to the bolt 24 to create torsional stresses.

Figure 2:
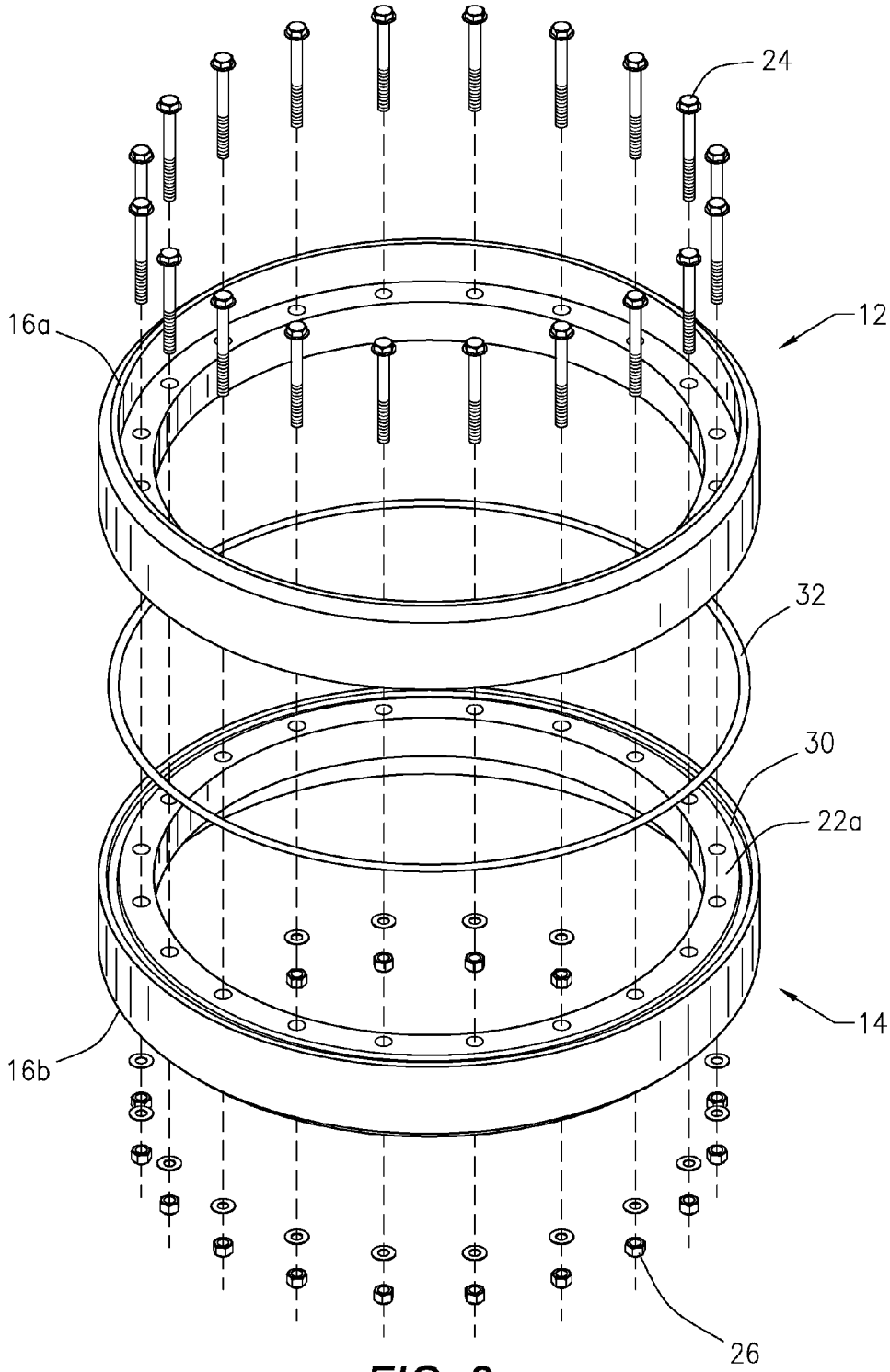
FIG. 2 is an exploded perspective view of an example of structural flanges with a ring gasket forming a mechanical bond between the structural flanges in accordance with an illustrative embodiment of the structural flange connection system and method disclosed herein.
Figure 3B:
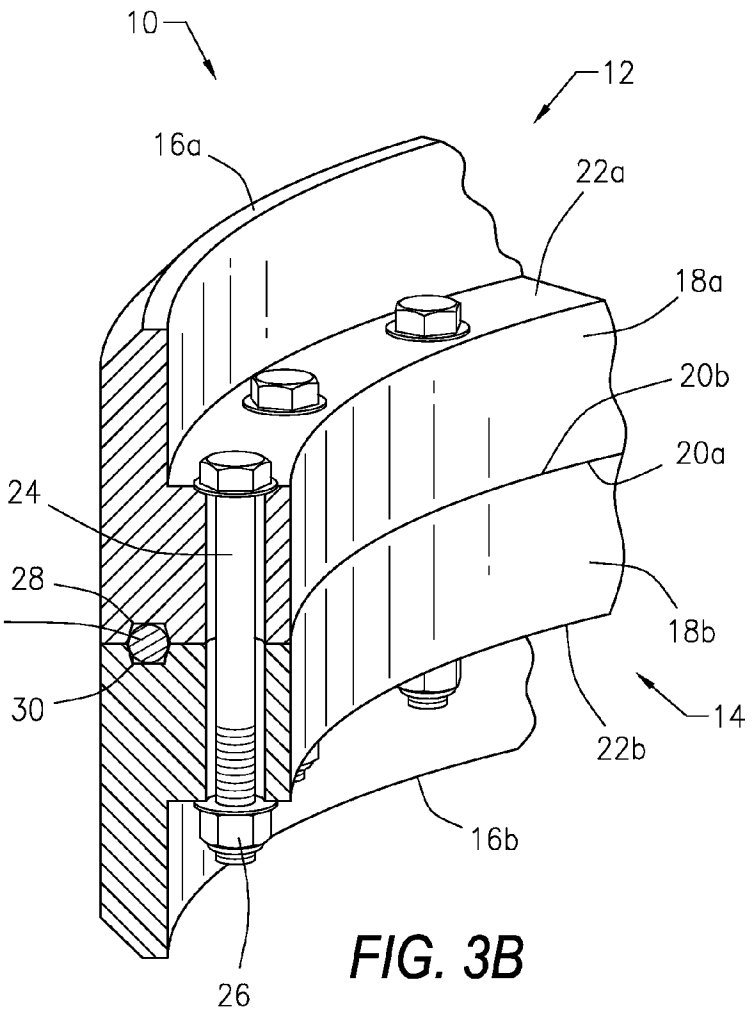
FIG. 3B is a cross-section view of the structural flange connection system and method shown in FIG. 3A.
Figure 3A:
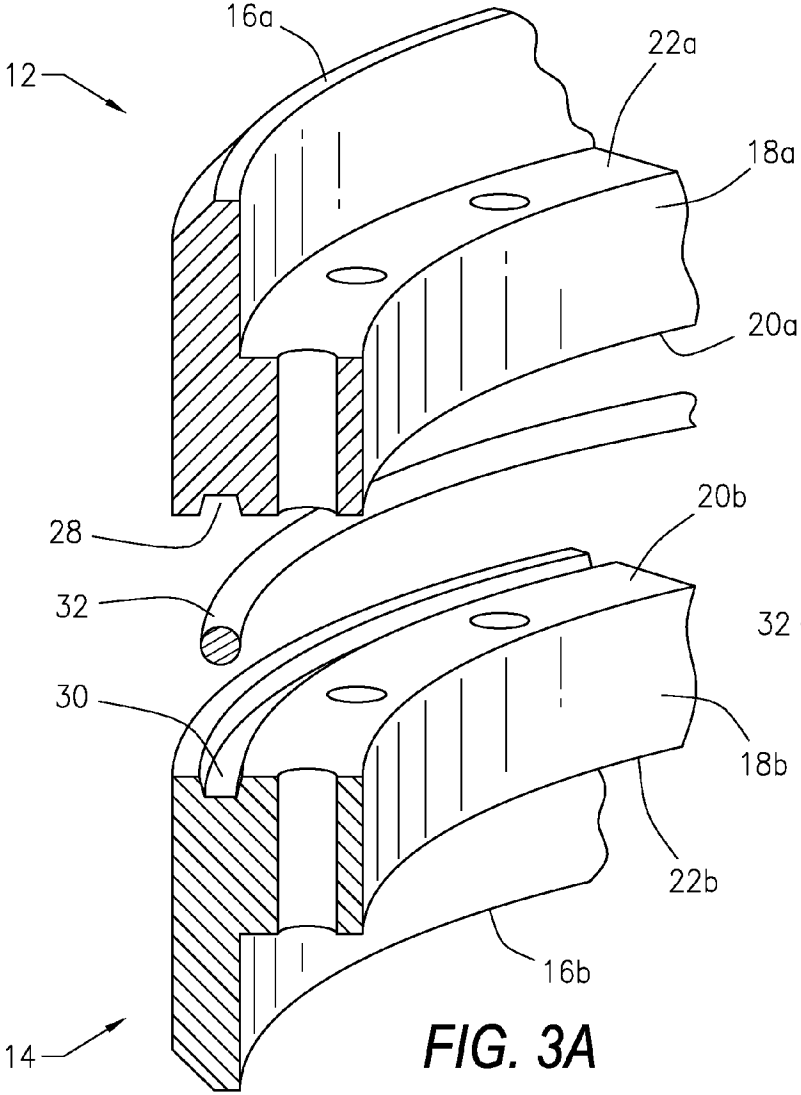
FIG. 3A an exploded cross-section view of the structural flange connection system and method shown in FIG. 2.

As illustrated in FIGS. 2, 3A and 3B, the structural flanges 12 and 14 can each contain a ring groove 28 and 30. The ring grooves 28 and 30 may be located upon the opposing faces 20*a* and 20*b* of structural flanges 12 and 14, respectively, such that the ring groove 28 on structural flange 12 aligns with the ring groove 30 on structural flange 14. The ring grooves 28 and 30 may extend around the opposing faces 20*a* and 20*b* of the structural flanges 12 and 16 such that they each form an annular channel between the faces 20*a* and 20*b* of the structural flanges 12 and 14. Prior to joining the structural flanges 12 and 14 together pursuant to the structural flange connection system and method 10, a ring gasket 32 may be placed between the structural flanges 12 and 14 in the ring grooves 28 and 30. The ring gasket 32 is thus retained between structural flanges 12 and 14 once the structural flanges 12 and 14 have been joined together pursuant to the structural flange connection system and method 10.

Figure 4B:
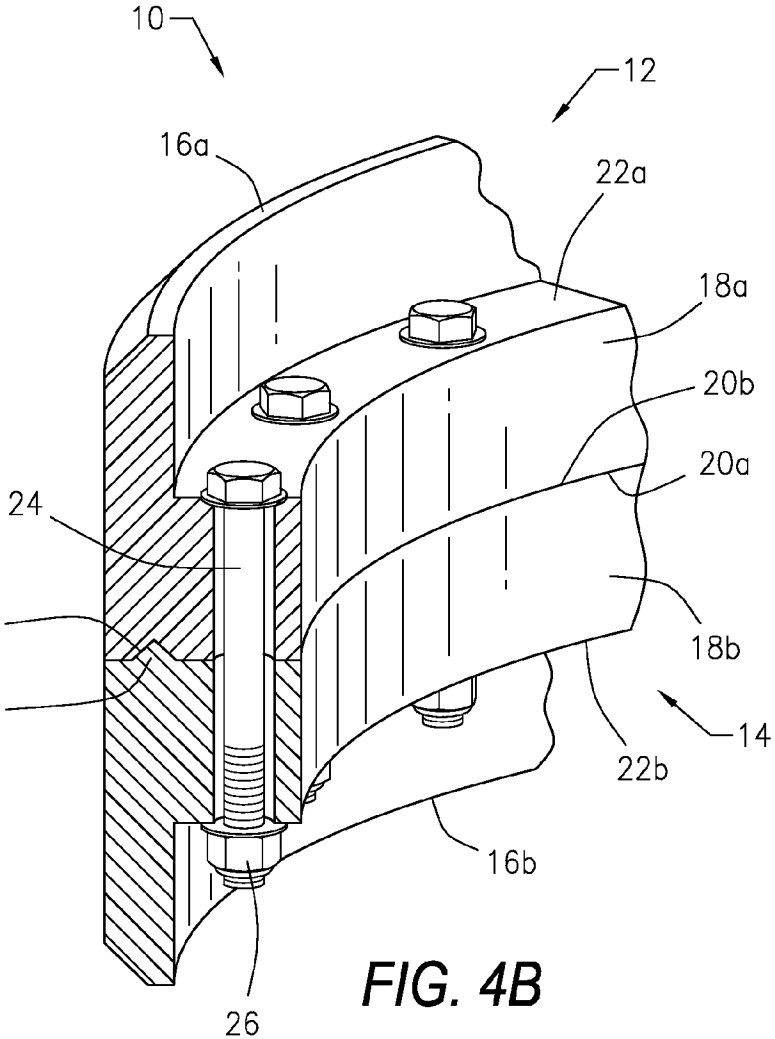
FIG. 4B is a cross-section view of the structural flange connection system and method shown in FIG. 4A.
Figure 4A:
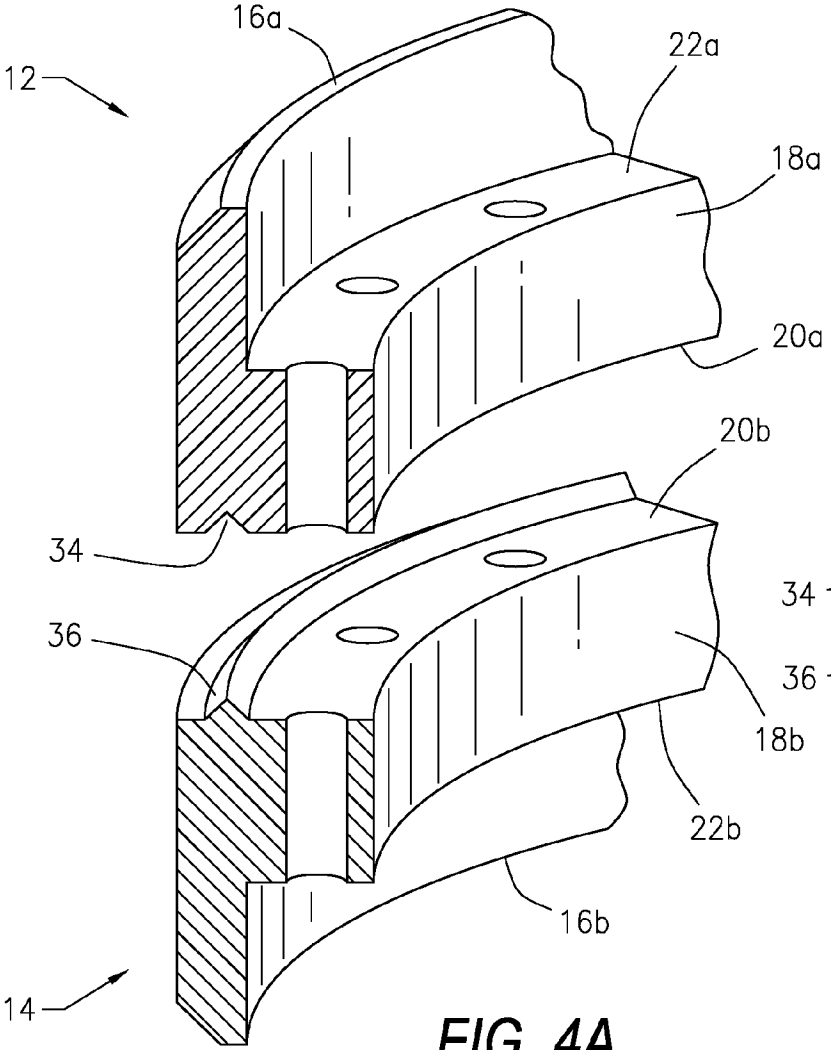
FIG. 4A is an exploded cross-section view of an example of structural flanges with a groove and a mating protrusion forming a mechanical bond between the structural flanges in accordance with an illustrative embodiment of the structural flange connection system and method disclosed herein.

Referring now to and as illustrated in FIGS. 4A and 4B, structural flange 12 can have a groove 34 located upon the face 20*a* of the lip 18*a* of the structural flange 12 and extending there around in an annular pattern. Likewise, structural flange 14 may have a mating protrusion 36 located upon the face 20*b* of the lip 18*b* of the structural flange 14 and extending there around in an annular pattern. The groove 34 and the mating protrusion 36 may be located on structural flanges 12 and 14, respectively, such that the groove 34 on structural flange 12 aligns with the mating protrusion 36 on structural flange 14 when the structural flanges 12 and 14 have been joined together pursuant to the structural flange connection system and method 10. The groove 34 may be substantially V- or U-shaped, while the mating protrusion 36 would be its mirror image, such as an inverted V- or U-shaped.

Figure 5B:
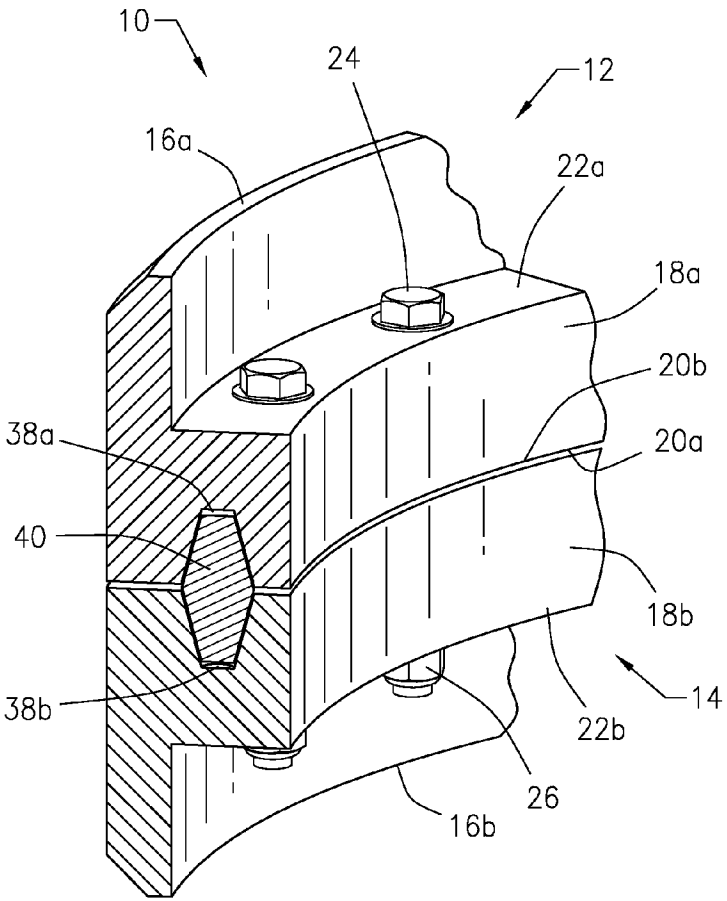
FIG. 5B is a cross-section view of the structural flange connection system and method shown in FIG. 5A.
Figure 5A:
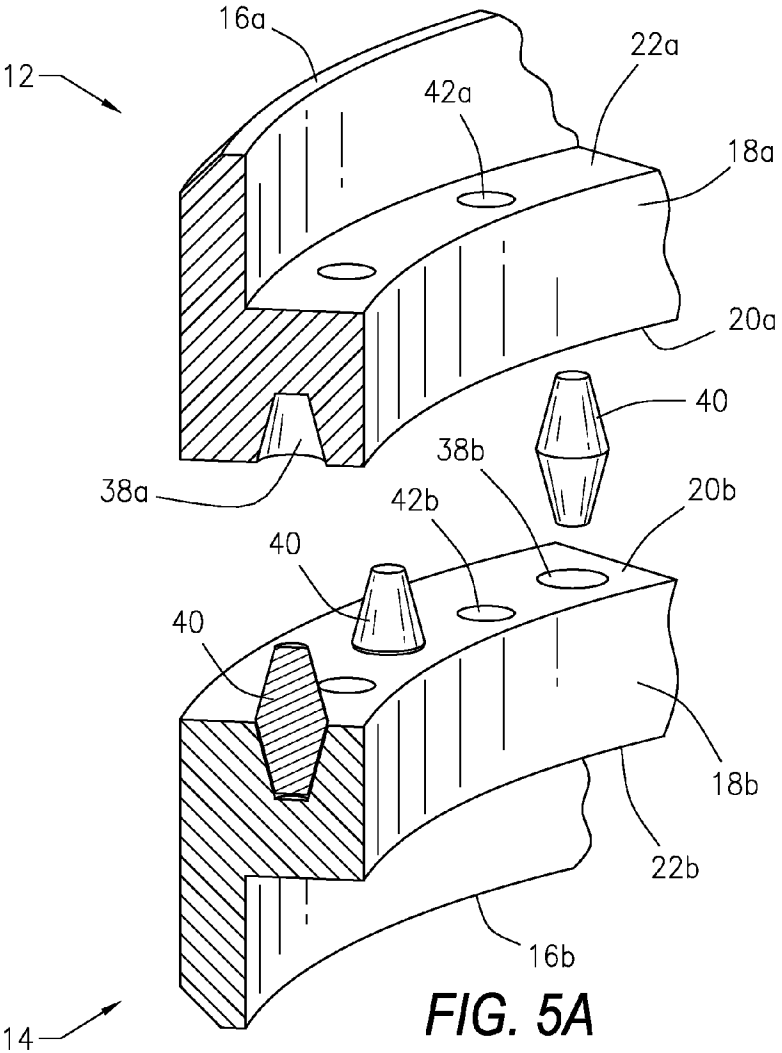
FIG. 5A is an exploded cross-section view of an example of structural flanges with a pin and a pin aperture forming a mechanical bond between the structural flanges in accordance with an illustrative embodiment of the structural flange connection system and method disclosed herein.

Turning now to and as illustrated in FIGS. 5A and 5B, the structural flanges 12 and 14 of the structural flange connection system and method 10 may each have a series of a pin apertures 38*a* and 38*b* located upon the opposing faces 20*a* and 20*b* of the structural flanges 12 and 14 such that the pin apertures 38*a* in the face 20*a* of the structural flange 12 align with the pin apertures 38*b* in the face 20*b* of the structural flange 14. The pin apertures 38*a* and 38*b* are recessed into the flange lips 18*a* and 18*b* and may be located in close proximity to and intermediate of the bolts 24, such that the pin apertures 38*a* and 38*b* alternate with apertures 42*a* and 42*b* through which the bolts 24 are passed. A series of pins 40 may be placed within the apertures 38*a* and 38*b* such that one end of each pin 40 fits in a pin aperture 38*a* in the structural flange 12 and the other end of the pin 40 fits in a pin aperture 38*b* in the structural flange 14. The pins 13 may be constructed of steel material, such as of a substantially equal tensile strength to the structural flanges 12 and 14 to insure a wedging of each pin 40 will occur when the bolt 24 is tightened.

The pins 40 and the pin apertures 38*a* and 38*b* of the structural flanges 12 and 14 may be corresponding in size and/or shape. For example, the pins 40 and the pin apertures 38*a* and 38*b* may be of a straight or tapered design allowing a wedging effect to occur as the bolts 24 are tightened, and thereby creating a strong mechanical bond between the structural flanges 12 and 14. In order to hold a pin 40 in a pin aperture 38*a/b*, the pin 40 may be press-fit into the pin apertures 38*a* and 38*b* with the pin 40 being slightly over-sized relative to the pin apertures 38*a* and 38*b*. As the pin 40 is forced into the pin apertures 38*a* and 38*b*, the pin apertures 38*a* and 38*b* expand and compresses the pin 40 and generating a holding force by the pressure developed by the expansion of the pin apertures 38*a* and 38*b* and the compression of the pin 40.

Again, straight pins 40 may be utilized with the structural flange connection system and method 10; however, the use of multiple straight pins 40 would require positions of the pin apertures 38*a* and 38*b* between the two flange faces 20*a* and 20*b* to match almost exactly, in order to effect the press-fit. Any positional variation between the pin apertures 38*a* of the structural flange 12 and the pin apertures 38*b* of the structural flange 14 would effect the diametric allowances between the pins 40 and would require an adjustment so that a clearance might exist to allow egging of the pins 40 into the pin apertures 38*a* and 38*b* between the two structural flanges 12 and 14, which would bear against the pin 40 and generate a load.

In order to create a substantially zero-clearance fit between the structural flanges 12 and 14, the pin 40 and the pin apertures 38*a* and 38*b* may be tapered so that the structural flange connection system and method 10 has a mechanical advantage for the pin 40 to expand the pin apertures 38*a* and 38*b* and for the pin apertures 38*a* and 38*b* to compress the pin 40. The resulting pressure from this expansion and compression with the coefficient of friction between the pin 40 and the pin apertures 38*a* and 38*b* allows the joint between the structural flanges 12 and 14 to bind, as in the press fit, if the inverse tangent of the angle of the taper is less than the coefficient of friction between the pin 40 and the pin apertures 38*a* and 38*b*. Furthermore, as the pin 40 is driven deeper into the pin apertures 38*a* and 38*b*, and the force generated by the coefficient of friction and the contact pressure is overcome, a higher degree of compression and expansion results, and a new level of holding force is generated. In this way, the tapered pin 40 walks itself into the pin apertures 38*a* and 38*b* until the seating force no longer exceeds the frictional force, or until the pin aperture 38*a* and/or 38*b* fails under tension. For the tapered pin joint of the structural flange connection system and method 10, the joint between the structural flanges 12 and 14 should capture the highest load experienced which exceeds the frictional force generated by the contact pressure of the connection. Conversely, an excess of this amount of force will be required to remove the pin 40 from the pin aperture 38*a* and/or 38*b*, by overcoming the force generated by the friction resulting from the connection contact pressures.

It will be appreciated that the tapered pin joint of the structural flange connection system and method 10 may utilize any taper for which commercial cutting tools exist or another optimal taper angle based on the particular usage of the structural flange connection system and method 10. Thus, the taper of the tapered pin joint of the structural flange connection system and method 10 may differ in (a) the diameter at the small end of the truncated cone of the pin 40 and/or the pin apertures 38*a* and 38*b*, (b) the diameter at the large end of the truncated cone of the pin 40 and/or the pin apertures 38*a* and 38*b*, and/or (c) the axial distance between the two ends of the truncated cone of the pin 40 and/or the pin apertures 38*a* and 38*b*. For example and not by way of limitation, the taper may be of a standard taper pin of about ¼" per foot or about 1.2° of taper or a Morse taper of about ⅝" per foot or about 3° of taper. There may be a single or multiple pins 40 at each location of the flange lips 18*a* and 18*b* of the structural flanges 12 and 14, such as eight (8), sixteen (16), or thirty-two (32) pins per flange or other predetermined number based on the diameter of the structural flange. The pins 40 may be located at each ninety (90) degree quadrant and at equal spaces in between as required per structural flange diameter.

The size of the pins 40 may also vary depending on the size of the structural flange. The tapered pins 40 should be sized such that the projected area of the tapered face of the pin 40 projected in the direction of the applied bolt force is of sufficient area to generate a stress in the material of less than the yield strength of the material for the joint to be effective. The tapered pin joint will reach equilibrium when the pressure generated as a result of the taper over the tapered pin area will generate a reactive force with the coefficient of friction between the two materials, which equals the bolt force plus any joint compressive force. In tension, this friction force generated by the pressure in the pins 40 and the friction between the pin 40 and the pin aperture 38*a* and 38*b* surfaces will then have to be overcome by external loading in the joint before the joint bolts 24 are impacted by tensile forces in the tapered pin joint.

When the arctangent of the angle of the taper is substantially equal to than the coefficient of friction, the force required to cause the pin 40 to slip in the pin apertures 38*a* and 38*b* and stretch it is equal to the friction force generated between the pin 40 and the pin apertures 38*a* and 38*b*. At this angle, the pin 40 will not seat; force can be applied and the pin 40 will not engage or stick in the pin apertures 38*a* and 38*b*. When the angle of the taper is such that the arctangent of the angle is less than the coefficient of friction, the pin 40 slides relative to the pin aperture 38*a* and 38*b* surfaces and stretches the pin apertures 38*a* and 38*b*, compresses the pin 40 and creates pressure. When this pressure and the coefficient of friction generate a reactive force equal to the force driving the pin 40 in the pin apertures 38*a* and 38*b*, the structural flange connection system and method 10 will be in equilibrium. Because a pressure has been created by deforming the pins 40 and the pin apertures 38*a* and 38*b*, a force equal to the peak seating force is required to dislodge the pin 40 from the pin apertures 38*a* and 38*b*.

Figure 6B:
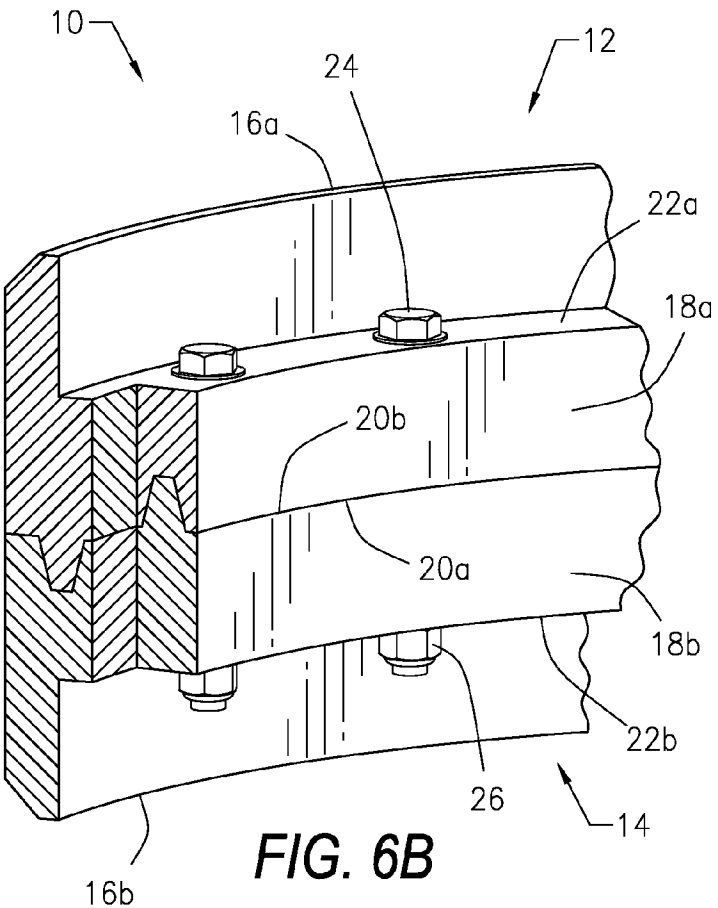
FIG. 6B is a cross-section view perspective view of the structural flange connection system and method shown in FIG. 6A.
Figure 6A:
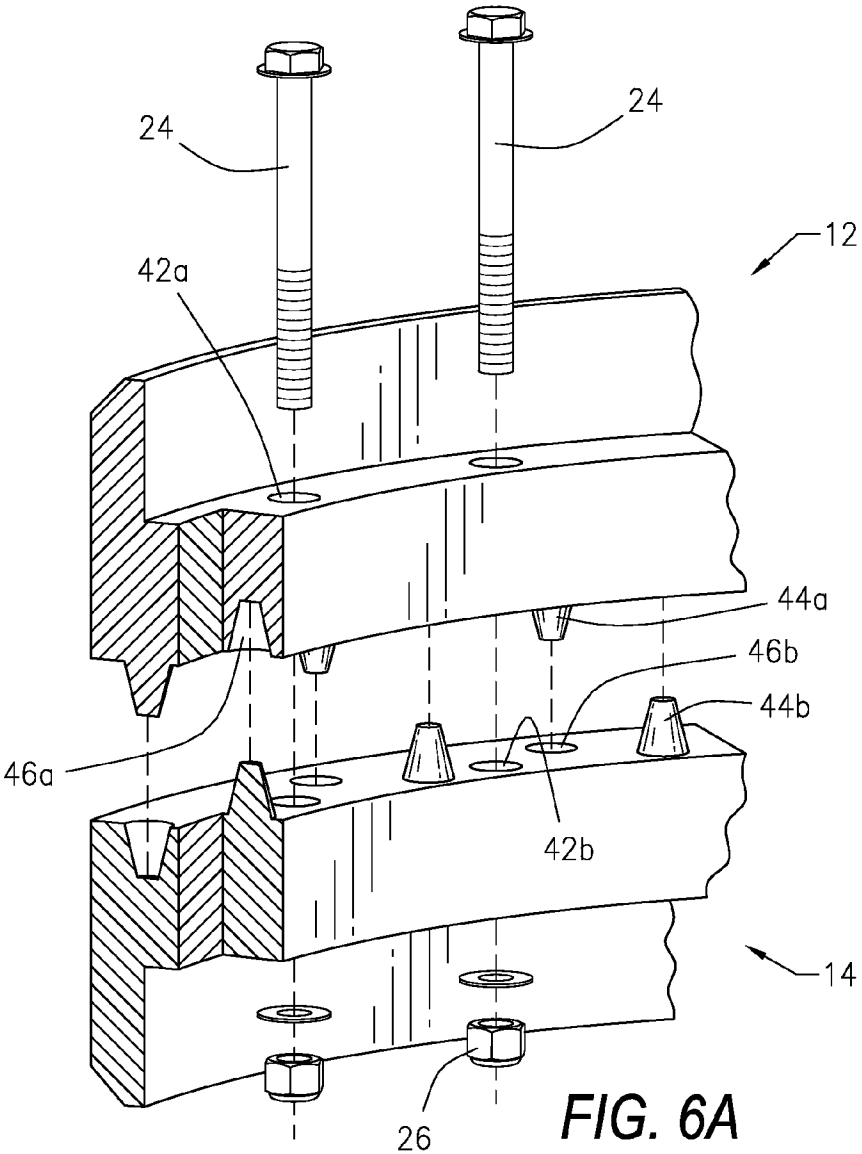
FIG. 6A is an exploded cross-section view of an example of structural flanges with a protruding frusta and a mating detent forming a mechanical bond between the structural flanges in accordance with an illustrative embodiment of the structural flange connection system and method disclosed herein.

Referring now to FIGS. 6A and 6B, the structural flanges 12 and 14 may respectively include a series of protruding frusta 44*a* and 44*b* and a series of mating detents 46*a* and 46*b* integrally made a part of the opposing faces 20*a* and 20*b*. As exemplified, the protruding frustums 44*a* of the structural flange 12 may be aligned along an outer diameter (or other measurement if the structural flanges 12 and 14 are not annular as exemplified) and the mating detents 46*a* may be aligned along an inner diameter of the face 20*a* of the structural flange 12. The mating detents 46*a* may alternate along the inner diameter of the face 20*a* of the structural flange 12 with the apertures 42*a* for the bolts 24. As for the structural flange 14, an inner diameter of the face 20*b* may include the apertures 42*b* for the bolts 24 alternating with the protruding frustums 44*b*, while an outer diameter of the face 20*b* may include the mating detents 46*b*. During use, when the structural flanges 12 and 14 are aligned, the bolts 24 will pass through the apertures 42*a* and 42*b* and can be secured using the nuts 26. Also when properly aligned, the protruding frustums 44*a* along the outer diameter of the face 20*a* of the structural flange 12 will fit into the mating detents 46*b* along the outer diameter of the face 20*b* of the structural flange 14, and the protruding frustums 44*b* along the inner diameter of the face 20*b* ofthe structural flange 14 will fit into the mating detents 46*a* along the inner diameter of the face 20*a* of the structural flange 12.

By way of exemplification, the structural flange connection system and method 10 may be utilized in the manufacture and installation of a wind turbine tower, which may be made up of one or more tower sections, and each tower section 48 may terminate in the structural flange connection system and method 10. Two tower sections 48*a* and 48*b*, where tower sections 48*a* and 48*b* respectively terminate in structural flanges 12 and 14 of the structural flange connection system and method 10, may be joined together. When properly aligned, the structural flanges 12 and 14 may be bolted together with the bolts 24 and secured with nuts 24. As discussed herein, the structural flanges include a mechanical bond, such as the ring gasket 32 and opposing ring grooves 28 and 30, the U- or V-shaped groove 34 and mating protrusion 36, the pins 40 and the pin apertures 38 or the protruding frustums 44 and mating detents 46, which are also joined together upon proper alignment of the structural flanges 12 and 14. Such manufacture of the wind turbine tower may occur in the field during installation of the wind turbine tower.

The result of the interaction of the elements of the structural flange connection system and method 10 is that when first put into service, the mechanical bond will be seated by the bolt load created by the torquing of the structural flange bolts. In initial service of the wind turbine tower, the mechanical bond will further seat due to any increase in joint load input by the compressive loads generated by bending loads in the wind turbine tower. These loads should further seat the mechanical bond, while relieving the bolt preloads. After the initial service period, it will be necessary to re-torque the joint bolts back to the specified assembly torque, in order to re-establish the initial joint preload. This will further compress the structural flanges of the structural flange connection system and method and will increase the joints resistance to fatigue, because the loads on the tension side would have to completely overcome the mechanical bond compression before the bolt loading changes.

The structural flanges with mechanical bonds will further create a dissipating and damping effect on harmonic vibrations. Furthermore, the structural flanges will be self aligning, which will aid in field assembly. Furthermore, the design of the structural flange connection system and method 10 addresses not only the issues of vibration, stress and bolt stretch, but also the movement forces of the wind turbine tower on the faces of the structural flanges, specifically the lateral and radial forces at each structural flange connection.

While described in relation to wind turbine tower design, the structural flange connection system and method disclosed herein may be utilized to join any adjacent sections of pipe, tube, etc., such is for pipelines, without departing from the spirit and scope of this invention. Further, while the systems and methods have been described in relation to the drawings and claims, it should be understood that other and further modifications, apart from those shown or suggested herein, may be made within the spirit and scope of this invention.

What is claimed is:

1. A tower section of a wind turbine tower, comprising:

a tower section comprising a tubular wall with opposing terminal ends;

a first structural flange comprising an outer rim and a flange lip having a face and a shoulder, the shoulder and the face of the flange lip are substantially perpendicular to the outer rim of the first structural flange, the first structural flange has a series of bolt apertures through the face and the shoulder of the flange lip of the first structural flange, the first structural flange has at least one structural element on the face of the first structural flange, the outer rim of the first structural flange is attached to a first terminal end of the tower section;

a second structural flange comprising an outer rim and a flange lip having a face and a shoulder, the shoulder and the face of the flange lip are substantially perpendicular to the outer rim of the second structural flange, the second structural flange has a series of bolt apertures through the face and the shoulder of the flange lip of the second structural flange, the second structural flange has at least one structural element on the face of the second structural flange, the outer rim of the second structural flange is attached to a second terminal end of the tower section; and wherein the face of the first structural flange opposes and is aligned along a parallel plane to the face of the second structural flange such that the face of the first structural flange is adjacent the face of the second structural flange, and wherein the first structural flange is axially spaced from and coaxially aligned with the second structural flange.

2. The tower section of claim 1 further comprising:

the first structural flange having a first ring groove located upon the face of the first structural flange;

the second structural flange having a second ring groove located upon the face of the second structural flange; and wherein the first ring groove and the second ring groove are located on the face of the first structural flange and the face of the second structural flange, respectively, such that the first ring groove aligns with the second ring groove when a first tower section is aligned with a second tower section.

3. The tower section of claim 2 further comprising a ring gasket between the first structural flange and the second structural flange such that the ring gasket is retained within the first ring groove and the second ring groove when the first tower section is aligned with the second tower section.

4. The tower section of claim 2 where the first ring groove extends around the face of the first structural flange in an annular pattern and the second ring groove extends around the face of the second structural flange in an annular pattern.

5. The tower section of claim 1 further comprising:

the first structural flange having a groove located upon the face of the first structural flange;

the second structural flange having a mating protrusion located upon the face of the second structural flange; and wherein the groove and the mating protrusion are located on the face of the first structural flange and the face of the second structural flange, respectively, such that the groove aligns with the mating protrusion when a first tower section is aligned with a second tower section.

6. The tower section of claim 5 where the groove is substantially V- or U-shaped and extends around the face of the first structural flange in an annular pattern and the mating protrusion is substantially an inverted V- or U-shape and extends around the face of the second structural flange in an annular pattern.

7. The tower section of claim 1 further comprising:

the first structural flange having a series of apertures located upon the face of the first structural flange;

the second structural flange having a series of apertures located upon the face of the second structural flange; and wherein the series of apertures located upon the face of the first structural flange and the series of apertures located upon the face of the second structural flange are located on the face of the first structural flange and the face of the second structural flange, respectively, such that the series of apertures located upon the face of the first structural flange aligns with the series of apertures located upon the face of the second structural flange when a first tower section is aligned with a second tower section.

8. The tower section of claim 7 further comprising a series of pins in the series of apertures located upon the face of the first structural flange and the series of apertures located upon the face of the second structural flange, such that each pin has a first end and a second end, the first end of each pin is located in one of the apertures in the series of apertures located upon the face of the first structural flange, and the second end of each pin is located in one of the apertures in the series of apertures located upon the face of the second structural flange when the first tower section is aligned with the second tower section.

9. The tower section of claim 8 where each of the pins is tapered on both the first end and on the second end, and where the series of pins alternate around the face of the first structural flange with a series of bolt apertures in the face of the first structural flange and around the face of the second structural flange with a series of bolt apertures in the face of the second structural flange.

10. The tower section of claim 9 where the series of apertures in the first structural flange and the second structural flange are tapered and where the arctangent of the angle of the taper of each of the pins and the series of apertures in the first structural flange and the second structural flange is less than the coefficient of friction between each of the pins and the series of apertures in the first structural flange and the second structural flange.

11. The tower section of claim 1 further comprising:

the face of the first structural flange having an inner span and an outer span, the outer span having a series of protruding frusta located on the face of the first structural flange, and the inner span having a series of mating detents located upon the face of the first structural flange;

the face of the second structural flange having an inner span and an outer span, the outer span having a series of mating detents located upon the face of the second structural flange, and the inner span having a series of protruding frusta located upon the face of the second structural flange; and wherein the series of protruding frusta located upon the outer span of the face of the first structural flange and the series of mating detents located upon the outer span of the face of the second structural flange are located on the outer span of the face of the first structural flange and the outer span of the face of the second structural flange, respectively, such that the series of protruding frusta located upon the outer span of the face of the first structural flange aligns with the series of mating detents located upon the outer span of the face of the second structural flange when a first tower section is aligned with a second tower section; and wherein the series of protruding frusta located upon the inner span of the face of the second structural flange and the series of mating detents located upon the inner span of the face of the first structural flange are located on the inner span of the face of the first structural flange and the inner span of the face of the second structural flange, respectively, such that the series of protruding frusta located upon the inner span of the face of the second structural flange aligns with the series of mating detents located upon the inner span of the face of the first structural flange when the first tower section is aligned with the second tower section.

12. The tower section of claim 11 wherein:

the inner span of the face of the first structural flange has the series of bolt apertures located upon the face of the first structural flange;

the inner span of the face of the second structural flange has the series of bolt apertures located upon the face of the second structural flange; and the series of bolt apertures located upon the inner span of the face of the first structural flange and of the second structural flange are located on the inner span of the face of the first structural flange and the inner span of the face of the second structural flange, respectively, such that the series of bolt apertures located upon the inner span of the face of the first structural flange aligns with the series of bolt apertures located upon the inner span of the face of the second structural flange when the first tower section is aligned with the second tower section.

13. The tower section of claim 11 where the arctangent of the angle of each of the protruding frusta and the series of mating detents in the first structural flange and the second structural flange is less than the coefficient of friction between each of the protruding frusta and the series of mating detents in the first structural flange and the second structural flange.

14. A structural flange connection for joining adjacent elements, comprising:

a first structural flange comprising an outer rim and a flange lip having a face and a shoulder, the shoulder and the face of the flange lip are substantially perpendicular to the outer rim of the first structural flange, the first structural flange has a series of bolt apertures through the face and the shoulder of the flange lip of the first structural flange, and the first structural flange having a series of apertures located upon the face of the first structural flange;

a second structural flange comprising an outer rim and a flange lip having a face and a shoulder, the shoulder and the face of the flange lip are substantially perpendicular to the outer rim of the second structural flange, the second structural flange has a series of bolt apertures through the face and the shoulder of the flange lip of the second structural flange, and the second structural flange having a series of apertures located upon the face of the second structural flange; and wherein the face of the first structural flange is adjacent the face of the second structural flange and wherein the series of apertures located upon the face of the first structural flange and the series of apertures located upon the face of the second structural flange are located on the face of the first structural flange and the face of the second structural flange, respectively, such that the series of apertures located upon the face of the first structural flange aligns with the series of apertures located upon the face of the second structural flange when a first element is aligned with a second element.

15. The structural flange connection of claim 14 further comprising a series of pins in the series of apertures located upon the face of the first structural flange and the series of apertures located upon the face of the second structural flange, such that each pin has a first end and a second end, the first end of each pin is located in one of the apertures in the series of apertures located upon the face of the first structural flange, and the second end of each pin is located in one of the apertures in the series of apertures located upon the face of the second structural flange when the first element is aligned with the second element.

16. The structural flange connection of claim 15 where each of the pins is tapered on both the first end and on the second end, and where the series of pins alternate around the face of the first structural flange with a series of bolt apertures in the face of the first structural flange and around the face of the second structural flange with a series of bolt apertures in the face of the second structural flange.

17. The structural flange connection claim 16 where the series of apertures in the first structural flange and the second structural flange are tapered and where the arctangent of the angle of the taper of each of the pins and the series of apertures in the first structural flange and the second structural flange is less than the coefficient of friction between each of the pins and the series of apertures in the first structural flange and the second structural flange.

18. The structural flange connection of claim 14 further comprising:

the face of the first structural flange having an inner span and an outer span, the outer span having a series of protruding frusta located on the face of the first structural flange, and the inner span having the series of apertures located upon the face of the first structural flange;

the face of the second structural flange having an inner span and an outer span, the outer span having a series of apertures located upon the face of the second structural flange, and the inner span having a series of protruding frusta located upon the face of the second structural flange;

wherein the series of protruding frusta located upon the outer span of the face of the first structural flange and the series of apertures located upon the outer span of the face of the second structural flange are located on the outer span of the face of the first structural flange and the outer span of the face of the second structural flange, respectively, such that the series of protruding frusta located upon the outer span of the face of the first structural flange aligns with the series of apertures located upon the outer span of the face of the second structural flange when the first element is aligned with the second element; and wherein the series of protruding frusta located upon the inner span of the face of the second structural flange and the series of apertures located upon the inner span of the face of the first structural flange are located on the inner span of the face of the first structural flange and the inner span of the face of the second structural flange, respectively, such that the series of protruding frusta located upon the inner span of the face of the second structural flange aligns with the series of apertures located upon the inner span of the face of the first structural flange when the first element is aligned with the second element.

19. The structural flange connection of claim 18 wherein:

the inner span of the face of the first structural flange has the series of bolt apertures located upon the face of the first structural flange;

the inner span of the face of the second structural flange has the series of bolt apertures located upon the face of the second structural flange; and the series of bolt apertures located upon the inner span of the face of the first structural flange and of the second structural flange are located on the inner span of the face of the first structural flange and the inner span of the face of the second structural flange, respectively, such that the series of bolt apertures located upon the inner span of the face of the first structural flange aligns with the series of bolt apertures located upon the inner span of the face of the second structural flange when the first element is aligned with the second element.

20. The structural flange connection of claim 16 where the arctangent of the angle of each of the protruding frusta and the series of mating detents in the first structural flange and the second structural flange is 1 than the coefficient of friction between each of the protruding frusta and the series of mating detents in the first structural flange and the second structural flange.

* * * * *